US005766836A

United States Patent [19]

Jones et al.

[11] Patent Number: 5,766,836

[45] Date of Patent: Jun. 16, 1998

[54] THREE-LAYER BACKING FOR PHOTOGRAPHIC ELEMENT

[75] Inventors: Raymond T. Jones, Webster; David M. Teegarden, Rochester; John M. Fukushima, Rochester; Ronald M. Stimson, Rochester, all of N.Y.

[73] Assignee: Eastman Kodak Company, Rochester, N.Y.

[21] Appl. No.: 789,981

[22] Filed: Jan. 28, 1997

[51] Int. Cl.[6] ..... G03C 1/85; G03C 1/89

[52] U.S. Cl. ..... 430/527; 430/529; 430/531; 430/535; 430/536; 430/961

[58] Field of Search ..... 430/215, 140, 430/527, 529, 531, 535, 536, 537, 961, 496, 528

[56] References Cited

U.S. PATENT DOCUMENTS

| | | | |
|---|---|---|---|
| 4,070,189 | 1/1978 | Kelley et al. | 430/528 |
| 4,203,769 | 5/1980 | Guestaux | 430/525 |
| 4,431,727 | 2/1984 | Steklenski | 430/527 |
| 4,459,352 | 7/1984 | Jones et al. | 430/539 |
| 5,006,451 | 4/1991 | Anderson et al. | 430/527 |
| 5,318,878 | 6/1994 | Jones et al. | 430/527 |
| 5,356,468 | 10/1994 | Havens et al. | 252/519 |
| 5,366,544 | 11/1994 | Jones et al. | 252/519 |

*Primary Examiner*—Richard L. Schilling
*Attorney, Agent, or Firm*—Carl F. Ruoff

[57] ABSTRACT

The present invention discloses a three layer backing system for a photographic element. The backing system in on the opposite side of the light-sensitive layer. The backing system includes a first antistatic layer having an antistatic agent. The backing system includes a barrier layer of a polymer. The overcoat layer, farthest from the support, includes cellulose acetate and cellulose nitrate in a ratio range of from 3:1 to 1:1 and from 5 to 40 percent perfluorinatied polymer particles.

13 Claims, 1 Drawing Sheet

THREE-LAYER BACKING FOR PHOTOGRAPHIC ELEMENT

FIELD OF THE INVENTION

This invention relates to a backing system for photographic elements. More particularly, the present invention provides a three-layer backing for a photographic element which provides humidity independent process surviving antistatic protection, lubricity and reduces scum formation during processing.

BACKGROUND OF THE INVENTION

Cellulosic film support used for consumer films can build up static charge when it is transported through coating machines during manufacture or through cameras during use. This static charge can discharge and fog the light sensitive emulsion layers, hence, the need for static protection. Since photographic films are used under a variety of humidity conditions, it would be advantageous to use a humidity independent antistatic agent to maximize static protection. If some antistatic agents are not protected from photographic processing solutions, they can lose their conductivity and the film is prone to pick up dust which leads to white spots on prints. A protected antistatic agent, in turn, would maintain its conductivity after processing and reduce or eliminate white spots on prints.

Another problem associated with processing of photographic films is that of scum formation. Sources of the scum include residual processing solution or salt deposits from hard water. A backing layer that minimizes the formation of scum reduces the need to clean negatives before printing is highly desirable.

The incorporation of a lubricant in a backing layer improves the transport of the support or film through production equipment and cameras and is highly desirable.

Thus, there still exists a need for an improved backing for photographic elements which provides all the above mentioned features. The present invention describes a three-layer backing for photographic elements which includes an antistatic layer containing an antistatic agent, a barrier layer of a water-insoluble polymer as a barrier to processing solutions overcoating the antistatic layer, and an overmost antiscum/lubricant layer comprising a mixture of cellulose acetate/cellulose nitrate/lubricant. The three-layer backing is coated on the side of the support opposite the light sensitive emulsion coated side. The backing provides humidity independent static protection, process surviving conductivity, minimized scum formation and lubricity.

SUMMARY OF THE INVENTION

The present invention comprises a photographic element having at least one light-sensitive layer on a front side of a support and a backing system on a backside of the support. The backing system includes, an antistatic layer nearest the support comprising an antistatic agent, an overlying barrier layer comprising water-insoluble polymeric material in sufficient amount to prevent photographic processing solutions from reaching the antistatic layer, and an overcoat layer farthest from the support comprising cellulose acetate and cellulose nitrate in a ratio of from 3:1 to 1:1 and from 5 to 40 weight percent perfluorinated polymer particles having a particle size less that 0.4 microns.

Figure 1:
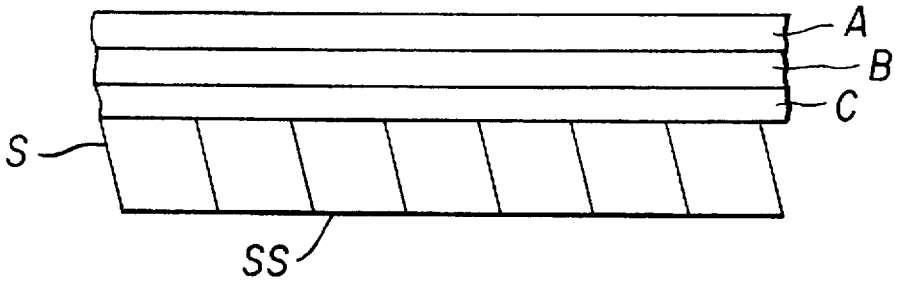
FIG. 1 shows the three-layer backing structure for photographic element of the present invention.

For a better understanding the present invention together with other objects, advantages and capabilities thereof, reference is made to the following description and appended claims in connection with the above described drawing.

DESCRIPTION OF THE PREFERRED EMBODIMENT

Photographic elements which can be provided with the backing system in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly-(ethylene terephthalate) film, poly(ethylene naphthalate) film, polycarbonate film, glass, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble vinyl polymers like poly(vinylpyrrolidone), acrylamide polymers, and the like. A particularly common example of an image-forming layer is a gelatin-silver halide emulsion layer.

Typical of useful paper supports are those which are partially acetylated or coated with baryta and/or polyolefin, particularly a polymer of an alpha-olefin containing 2 to 10 carbon atoms in the repeating unit, such as polyethylene, polypropylene, copolymers of ethylene and propylene and the like.

Suitable antistatic agents for the antistatic layer of the present invention include vanadium pentoxide; vinyl benzene quaternary ammonium polymers; an ester of cellulose having at least 8 acyl groups per $C_{24}$ cellulose unit wherein at least a majority of the acyl groups are derived from an aliphatic polycarboxylic acid having 3 to 6 carbon atoms, or a salt of the ester; or a copolymer of a vinyl benzene sulfonic acid and an ethylenically unsaturated monomer containing at least one primary hydroxyl group crosslinked with a methoxyalkylmelamine. These antistatic agents are described in U.S. Pat. Nos. 4,070,189; 4,203,769; 4,459,352 and 5,318,878. The antistatic layer is typically prepared by coating of a colloidal solution of the antistatic agent. To achieve improved bonding to poly(ethylene terephthalate) PET and poly(ethylene naphthatate) PEN a polymeric binder, such as a latex of a terpolymer of acrylonitrile, vinylidene chloride and acrylic acid, can be added to the colloidal solution of the antistatic agent. In addition to the binder and antistatic agent, the coating composition employed to form the antistatic layer can contain a wetting agent to promote coatability.

The essential component of the barrier layer employed in the support materials of this invention is a polymer, copolymer or polymer blend having sufficient hydrophobic functionality such that water and photoprocessing solutions are prevented from penetrating to the antistatic layer. Optional additional components of the barrier layer include a coalescing agent, a wetting agent, and a crosslinking agent. The coalescing agent is employed to aid in forming a high quality continuous film that is effective as a barrier. The purpose of including the wetting agent is to promote coatabilities.

The overcoat layer of the present invention provides lubricity and prevents scum formation to the photographic film element. This layer can include additional components such as a coalescing agent or matte particles and a crosslinking agent.

FIG. 1 shows the three-layer backing system for use on acetate support to eliminate scum after processing. The three-layer system includes an antistatic layer labeled C in FIG. 1. This antistatic layer can be any antistatic layer used in photographic film elements and more preferably, a vanadium pentoxide/cellulose nitrate antistatic layer as described in U.S. Pat. Nos. 4,203,769, 5,006,451, 5,356,468 and 5,366,544. The preferred coating composition of the antistatic layer is 0.05 weight percent vanadium pentoxide and 0.1 weight percent cellulose nitrate with the balance being the coating vehicle. When the film support is cellulose acetate, the coating vehicle for the coating composition is primarily solvent. Suitable solvents include ketones, such as acetone, methylethyl ketone, diethyl ketone, dibutyl ketone and the like; alcohols, such as, methanol, ethanol, n-propanol, isopropanol, tert-butanol; water and the like. A particularly suitable solvent includes and mixture of acetone, an alcohol and water. The vanadium pentoxide/cellulose nitrate layer should be applied at a dry coverage of at least 0.3 mg/sqft, preferably from about 0.8 to about 4 mg/sqft.

Layer B is a barrier layer designed to prevent the loss of conductivity of the antistatic agent during photographic processing. It is a polymeric material or blend of polymeric materials that resists the passage of water and/or ionic species that will react with or otherwise interfere with the conductivity of the antistatic agent. Materials known to have sufficient barrier properties at reasonable coating thickness include cellulose diacetate, cellulose triacetate, cellulose acetate proprionate, cellulose acetate butyrate, cellulose nitrate, copolymers of such materials and compatible blends of these cellulosic polymers; poly(alkyl methacrylates) such as poly(methyl methacrylate), poly(ethyl methacrylate), poly(propyl methacrylate), poly(n-butyl methacrylate), poly (isobutyl methacrylate), poly(t-butyl methacrylate), poly (lauryl methacrylate), and the like, copolymers of such methacrylates, and compatible blends of such poly (alkyl methacrylates). Co- and terpolymers of methacrylates containing low relative amounts of functional groups such as carboxylic acids can also be used. Many commercially available polymers are known to work, e.g. the Elvacite® family of acrylic resins from ICI Acrylics. Other vinyl polymers that are useful include poly(vinyl acetate), polyvinylbutyral, poly(fluorethylene-co-ethyl vinyl ether) (e.g. Lumiflon®), styrene-acrylonitrile copolymers (e.g. Lustran® SAN 33, Lustran® SAN LK 302) and acrylonitrile-butadiene-styrene copolymers (e.g. Lustran Mediclear® 266).

Preferred latex polymers for the barrier layer of this invention are copolymers of 1) one or more polymerizable monomers selected from the group consisting of styrene alkyl acrylates and alkyl methacrylates with 2) one or more substituted polymerizable monomers selected from the group consisting of styrenes, alkyl acrylates and alkyl methacrylates that have been substituted with a hydrophilic functional group such as an aminoalkyl salt group or a hydroxyalkyl group.

Examples of Group I comonomers include: styrene; ethyl alkylacrylate, ethyl methacrylate, butyl acrylate, butyl methacrylate and the like. Examples of Group II comonomers include 2-amino ethyl methacrylate hydrochloride-2-hydroxy ethyl acrylate, 2-hydroxy ethyl methacrylate, N-(3-aminopropyl)methacrylate hydrochloride, p-aminostyrene hydrochloride and the like.

Examples of preferred latex polymers for the barrier layer of this invention include: poly(ethylacrylate-co-2-aminoethyl methacrylate hydrochloride-co-2-hydroxyethyl methacrylate), poly(ethyl acrylate-co-styrene-co-2-aminoethyl methacrylate hydrochloride), poly(ethyl acrylate-co-styrene-co-2-aminoethyl methacrylate hydrochloride-co-2-hydroxyethyl methacrylate), poly (butyacrylate-co-styrene-co-2-aminoethyl methacrylate hydrochloride), poly(ethyl acrylate-co-methyl methacrylate-co-2-aminoethyl methacrylate hydrochloride-2-co-2-hydroxyethyl methacrylate), poly(ethyl acrylate-co-butyl methacrylate-co-2-aminoethyl methacrylate hydrochloride-co-2-aminoethyl-hydroxyethyl methacrylate), and the like.

The preferred barrier layer is poly(isobutyl methacrylate) (e.g. Elvacite® 2045). The coating composition for this layer is from 1 to 3 weight percent of Elvacite® 2045 with a preferred concentration of 2.5 weight percent and the balance being the coating vehicle. The coating vehicle for this layer is a solvent. Suitable solvents include ketones such as acetone, methylethyl ketone, diethyl ketone, dibutyl ketone and the like; alcohols, such as, methanol, ethanol, n-propanol, isopropanol, n-butanol, isobutanol, tert-butanol and the like. Most preferably a mixture of acetone and methanol is used. This layer is applied at a dry coverage of from 10 to 200 mg/sqft, preferably at about 40 mg/sq ft.

Finally, layer A, as shown in FIG. 1 is a topcoat which prevents formation of hard water scum and provides lubricity to the photographic film element. This layer comprises a mixture of cellulose acetate, cellulose nitrate and perfluorinated polymer particles having a size of less than about 0.4 microns. Any suitable ethylenically unsaturated perfluorinated monomers can be used for the preparation of the perfluorinated polymer particles, such as, for example, tetrafluoroethylene, hexafluoropropylene, perfluorovinyl ether including perfluoro(methyl vinyl either) and perfluoro (propyl vinyl ether). The perfluorinated polymer particles can also be made of copolymers of perfluorinated monomers with other ethylenically unsaturated monomers such as vinylidene fluoride, vinyl fluoride, chlorotrifluoroethylene, ethylene, propylene, and the like.

Perfluorinated polymer particles useful for the practice of the present invention include, for example, FEP 120 and Teflon PFA 335J, manufactured by E. I. du Pont de Nemours & Co. FEP 120 is an aqueous dispersion of tetrafluoroethylene-hexafluoropropylene copolymer and has a particle size from 0.1 to 0.26 μm. Teflon PFA 335J is an aqueous dispersion of tetrafluoroethylene-perfluorovinyl ether copolymers and has a particle size of from 0.1 to 0.25 μm.

The cellulose acetate used in this layer preferrably has an acetyl content of 32 percent acetyl or less. Higher acetyl contents are less effective at minimizing the formation of scum. The cellulose nitrate in layer A provides superior adhesion of this layer to the barrier layer when the ratio of the cellulose acetate to cellulose nitrate is between 1.5:1 and 1:1. The perfluorinated or polytetrafluoroethylene polymer particles used as the lubricant in this layer can be varied from 5 to 40 weight of the cellulose esters. The coating vehicle for this layer is primarily solvent. Suitable solvents include ketones such as acetone, methylethyl ketone, diethyl ketone, dibutyl ketone and the like; alcohols, such as, methanol, ethanol, n-propanol, isopropanol, n-butanol, isobutanol, tert-butanol; water and the like. A particularly suitable solvent includes a mixture of acetone, an alcohol and water. Most preferably a mixture of acetone, methanol and water is used. This layer should be applied at a dry coverage of from 10 to 200 mg/sq ft, preferably at 25 mg/sq ft.

The sensitized side of the film support labeled SS is not shown with any light-sensitive layers. This layer may be sensitized to a particular spectrum of radiation with, for example, a sensitizing dye, as is known in the art. Additional light-sensitive layers may be sensitized to other portions of the spectrum. The light-sensitive layers may contain or have associated therewith dye-forming compounds or couplers. For example, a red-sensitive emulsion would generally have a cyan coupler associated therewith, a green-sensitive emulsion would be associated with a magenta coupler, and blue-sensitive emulsion would be associated with a yellow coupler. Other layers and addenda such as antistatic compositions, subbing layers, surfactants, filter dyes, protective layers, barrier layers, development inhibiting releasing compounds, and the like can be present in photographic elements of the invention, as is well known in the art. Detailed descriptions of photographic elements and their various layers and addenda can be found in the above-identified *Research Disclosure* 36320 and in James, "The Theory of the Photographic Process", Fourth Edition, 1977.

If desired, the photographic element can be used in conjunction with a transparent magnetic layer described in *Research Disclosure*, Nov. 1992, Item 34390.

The following examples further illustrate the present invention.

Table 1 lists the water electrode resistivities (WER) of the three-layer backings before and after C-41 processing when various polymers are machine coated as a barrier layer over the vanadium pentoxide/cellulose nitrate antistatic agent and beneath the scum/lubricant layer for preventing the loss of conductivity of the vanadium pentoxide.

TABLE 1

| | WER Before/After C-41 log ohms |
|---|---|
| Cellulose Nitrate | 6.8/7.0 |
| 3/1 Cellulose Diacetate/Cellulose Nitrate | 7.5/7.6 |
| Cellulose Acetate Butyrate | 6.8/7.1 |
| Cellulose Acetate Propionate | 6.9/7.3 |
| Cellulose Diacetate | 8.9/8.4 |
| Cellulose Triacetate | 8.2/8.1 |
| Poly(methyl methacrylate) (Elvacite 2008) | 6.9/7.1 |
| Poly(methyl methacrylate) (Elvacite 2009) | 6.9/7.1 |
| Poly(methyl methacrylate) (Elvacite 2041) | 7.3/7.1 |
| Poly(methyl methacrylate) (Elvacite 2021) | 7.4/7.8 |
| Poly(methyl methacrylate) (Elvacite 2010) | 7.3/7.7 |
| Poly(isobutyl methacrylate) (Elvacite 2045) | 7.5/7.5 |
| Methylmethacrylate Copolymer (Elvacite 2028) | 7.2/7.0 |
| Methylmethacrylate/n-Butylmethacrylate/Methacrylic Acid Terpolymer (20/75/05) | 7.5/7.1 |

TABLE 1-continued

| | WER Before/After C-41 log ohms |
|---|---|
| Methylmethacrylate/n-Butylmethacrylate/Methacrylic Acid Terpolymer (45/50/05) | 7.2/7.2 |
| 3/1 2041/2045 | 7.3/7.1 |
| 1/1 2041/2045 | 7.2/7.2 |
| 1/3 2041/2045 | 7.2/7.2 |
| 1/1 2041/2009 | 6.9/6.9 |
| 1/1 2041/2010 | 7.7/7.5 |
| 1/1 2021/2009 | 7.9/7.8 |
| 1/1 2021/2010 | 8.0/8.2 |
| Polyvinylbutyral (Butvar B-78) | 7.2/7.4 |
| Polyvinylbutyral (Butvar B-98) | 7.1/7.4 |
| Polyvinylacetate (Vinac B-25) | 7.5/7.2 |
| Styrene-acrylonitrile Co-polymer (SAN 33) | 7.5/7.5 |
| Styreneacrylonitrile Co-polymer (SAN 302) | 7.4/7.7 |

The WER data show very little change before and after C-41 processing indicating that these materials perform extremely well as barriers independently and in some cases as blends for protecting the vanadium pentoxide. The preferred material for use as the barrier in this invention is, for example, poly(isobutyl methacrylate),(e.g. Elvacite® 2045).

Table 2 lists the scum propensity of the three-layer backings after processing and immersion in C-41 Stabilizer doctored with 300 to 500 ppm calcium.

The doctoring of the C-41 stabilizer is to mimic hard water condition. Adhesion data of the antiscum/lubricant layer to the barrier layer is shown in Table 2 and the IMASS friction is shown in Table 3.

The adhesion test is performed by scoring the backing with a sharp instrument, applying a piece of tape over the scored areas, abruptly removing the tape and scrutinizing the scored area for material loss. The three layer coatings were machine coated with the antistatic layer at a dry coverage of about 3 mg/sq ft, the barrier layer at about 40 mg/ sq ft and the antiscum/lubricant layer at about 25 mg/sq ft. The variations in the antiscum/lubricant solutions include the ratio of CA 320S (cellulose acetate) and cellulose nitrate in five or ten percent increments from 50 percent/50 percent to 75 percent/25 percent with 20 weight percent Teflon FEP 120 added based on the weight of the cellulose esters except for the 50/50 ratio that contains 30 weight percent Teflon FEP 120 added based on the weight of the cellulose esters.

TABLE 2

| Ratio of CA320S/ Cellulose Nitrate/ Teflon FEP | Scum After | Scum After C-41 + Stab. + ppm Ca | | Tape Test |
|---|---|---|---|---|
| 120 | C-41 | 300 | 500 | Adhesion |
| 50/50 | None | None | None | OK |
| 55/45 | None | None | None | OK |
| 60/40 | None | None | None | OK |
| 65/35 | None | None | None | Removal |
| 75/25 | None | None | None | Removal |
| Kodacolor Check | None | None | None | OK |

The data in Table 2 show these antiscum layers have no scum after C-41 processing or after C-41 processing and immersion in stabilizer doctored to 300 ppm or 500 ppm calcium, the same as Kodacolor. Good adhesion of the antiscum/lubricant layer to the barrier layers is attainable at ratios of 60/40 weight percent of CA320S cellulose nitrate and lower.

Table 3 lists the IMASS friction for the three layer backings with the antiscum/lubricant layer comprising 50/50 CA320S/cellulose nitrate, with 0, 10, 15, 20, 25, and 30 weight percent Teflon FEP 120 added based on the weight of the cellulose esters.

TABLE 3

| CA320S/Cellulose Nitrate wt. % Teflon FEP 120 | IMASS Friction After C-41 |
|---|---|
| 0 | 0.55 |
| 10 | 0.34 |
| 15 | 0.35 |
| 20 | 0.24 |
| 25 | 0.22 |
| 30 | 0.22 |
| Kodacolor Check | 0.12 |

The IMASS friction data on Table 3 show that the features have friction values in the range of 0.22 to 0.34 while Kodacolor is 0.12.

The invention has been described in detail with particular reference to certain preferred embodiments thereof, but it will be understood that variations and modifications can be effected within the spirit and scope of the invention.

What is claimed is:

1. A photographic element having at least one light-sensitive layer on a front side of a support and a backing system on a backside of the support, the backing system comprising:

a) an antistatic layer nearest the support comprising an antistatic agent, b) an overlying barrier layer comprising a water-insoluble polymeric material in sufficient amount to prevent photographic processsing solutions from reaching said antistatic layer, c) an overcoat layer farthest from the support comprising cellulose acetate and cellulose nitrate in a weight ratio of from 3:1 to 1:1 and from 5 to 40 weight percent perfluorinated polymer particles having a particle size less than 0.4 microns.

2. The photographic element according to claim 1, wherein the support is selected from the group consisting of cellulose ester film, cellulose nitrate film, cellulose acetate film, poly(vinyl acetal) film, polystyrene film, poly-(ethylene terephthalate) film, poly(ethylene naphthalate) film, polycarbonate film, glass, paper, and polymer-coated paper.

3. The photographic element according to claim 1 wherein the antistatic agent comprises vanadium pentoxide; vinyl benzene quaternary ammonium polymers; an ester of cellulose having at least 8 acyl groups per $C_{24}$ cellulose unit wherein at least a majority of the acyl groups are derived from an aliphatic polycarboxylic acid having 3 to 6 carbon atoms, or a salt of the ester; or a copolymer of a vinyl benzene sulfonic acid and an ethylenically unsaturated monomer containing at least one primary hydroxyl group crosslinked with a methoxyalkylmelamine.

4. The photographic element according to claim 1 wherein the antistatic layer further comprises a polymeric binder.

5. The photographic element according to claim 4 wherein the polymeric binder comprises cellulose nitrate.

6. The photographic element according to claim 5 wherein the antistatic layer has a dry coverage of from 0.8 to 4 mg/sq ft.

7. The photographic element according to claim 1 wherein the polymer of the barrier layer is selected from the group consisting of cellulose diacetate, cellulose triacetate, cellulose acetate proprionate, cellulose acetate butyrate, cellulose nitrate, poly(ethyl methacrylate), poly(propyl methacrylate), poly(n-butyl methacrylate), poly(isobutyl methacrylate), poly(t-butyl methacrylate), poly(lauryl methacrylate), poly (ethylacrylate-co-2-aminoethyl methacrylate hydrochloride-co-2-hydroxyethyl methacrylate), poly(ethyl acrylate-co-styrene-co-2-aminoethyl methacrylate hydrochloride), poly (ethyl acrylate-co-styrene-co-2-aminoethyl methacrylate hydrochloride-co-2-hydroxyethyl methacrylate), poly (butyacrylate-co-styrene-co-2-aminoethyl methacrylate hydrochloride), poly(ethyl acrylate-co-methyl methacrylate-co-2-aminoethyl methacrylate hydrochloride-2-co-2-hydroxyethyl methacrylate), poly(ethyl acrylate-co-butyl methacrylate-co-2-aminoethyl methacrylate hydrochloride-co-2-aminoethyl-hydroxyethyl methacrylate), poly(vinyl acetate), polyvinylbutyral, poly(fluorethylene-co-ethyl vinyl ether), styrene-acrylonitrile copolymers, and acrylonitrile-butadiene-styrene copolymers.

8. The photographic element according to claim 1 wherein the barrier layer further comprises a coalescing agent.

9. The photographic element according to claim 1 wherein the barrier layer further comprises a wetting agent.

10. The photographic element according to claim 1 wherein the barrier layer further comprises crosslinking agents.

11. The photographic element according to claim 1 wherein the barrier layer has a dry coverage of from 10 to 200 mg/sqft.

12. The photographic element according to claim 1 wherein the overcoat layer has a dry coverage of from 10 to 200 mg/sqft.

13. The photographic element according to claim 1 wherein the cellulose acetate of the overcoat layer has an acetyl content of about 32 percent.

* * * * *